US005078314A

United States Patent [19]

Shibahara

[11] Patent Number: 5,078,314

[45] Date of Patent: Jan. 7, 1992

[54] TWO-WAY COMMUNICATION MEDIUM IN THE FORM OF DOUBLE POST CARD OR THE LIKE

[75] Inventor: Kenji Shibahara, Osaka, Japan

[73] Assignee: Kabushiki Kaisha Challenge Five, Osaka, Japan

[21] Appl. No.: 506,867

[22] Filed: Apr. 9, 1990

[30] Foreign Application Priority Data

Jul. 21, 1989 [JP] Japan ..... 1-85974[U]

[51] Int. Cl.[5] ..... B42D 15/04

[52] U.S. Cl. ..... 229/92.8; 206/813; 283/106

[58] Field of Search ..... 156/306.3, 152; 428/40; 206/813; 229/92.8; 283/101, 106

[56] References Cited

U.S. PATENT DOCUMENTS

| | | | |
|---|---|---|---|
| 203,409 | 5/1878 | Brooks | 229/92.8 |
| 225,319 | 3/1880 | Barton | 229/92.8 |
| 339,889 | 4/1886 | Homan | 229/92.8 |
| 576,552 | 2/1897 | Cook | 229/92.8 |
| 961,829 | 6/1910 | Wooldridge | 229/92.8 |
| 2,018,984 | 10/1935 | Mackelenbergh | 229/92.8 |
| 2,074,821 | 3/1937 | Wissmann | 229/92.8 |
| 2,168,920 | 8/1939 | Wissmann | 229/92.8 |
| 2,270,455 | 1/1942 | Lichter | 229/92.8 |
| 2,365,789 | 12/1944 | Weinschenk | 229/92.8 |
| 3,329,333 | 7/1967 | Ormond | 229/92.8 |
| 4,742,954 | 5/1988 | Shishido | 229/92.8 |
| 4,807,807 | 2/1989 | Glick | 206/813 |
| 4,817,989 | 4/1989 | Pendergast | 229/92.8 |
| 4,865,247 | 9/1989 | Grabner | 229/92.8 |

FOREIGN PATENT DOCUMENTS

| | | | |
|---|---|---|---|
| 1024830 | 4/1953 | France | 229/92.8 |
| 214484 | 8/1989 | Japan | 283/106 |
| 214485 | 8/1989 | Japan | 283/106 |
| 2091 | 1/1990 | Japan | 283/106 |
| 26990 | 10/1902 | Switzerland | 229/92.8 |

*Primary Examiner*—Stephen P. Garbe
*Attorney, Agent, or Firm*—Koda and Androlia

[57] ABSTRACT

The invention concerns a two-way communication medium in the form of double post card or the like which enables easy communication of information in secret during both forward mailing and reply mailing, and which can be opened with little or no trouble for reading of the information.

Sheet portions of the two way communication medium body are folded one over another with the information written surface or surfaces placed inside. A releasably adherent insertion sheet is interposed between the superposed sheets. The insertion sheet provides good adhesion contact between its surfaces and individual sheet portion surfaces.

5 Claims, 17 Drawing Sheets

TWO-WAY COMMUNICATION MEDIUM IN THE FORM OF DOUBLE POST CARD OR THE LIKE

BACKGROUND OF THE INVENTION

1. Field of the Invention

This invention relates to a two-way communication medium in the form of double post card or the like for use in communicating, in concealed condition, written information requiring secrecy.

2. Description of Background Art

Hitherto, a double post card of the type which is shown in FIG. 10 has been commercially available as a medium for two-way communication.

Such post card, as generally shown in (a) and (b) of FIG. 10, comprises forward and reply communication sheet portions 1, 2 formed in continuation, the reply sheet portion being adapted to be preprinted with the name and address of an addressee for reply. In this way, the double post card is mainly intended to serve for the convenience of the replier by previously arranging for reducing the expense and trouble which would otherwise be involved on the replier's side. However, as can be seen from (c) and (d) of FIG. 10, such double post card is not intended to keep secrecy of the content of the communication, it being simply folded double without having the sheet portions 1, 2 sticked together by pasting or otherwise when it is initially sent, as well as when it is sent for reply.

SUMMARY OF THE INVENTION

As stated above, such known double post card is not intended to avoid exposure of the content of the communication either in the forward course of mail or in the return course of mail. Therefore, the content of the communication is exposed to the risk of being disclosed to the outside, which poses a serious problem from the standpoint of secrecy.

This invention is directed to solving the above mentioned problem, and accordingly it is an object of the invention to provide a two-way communication medium which enables positive and easy protection from disclosure and, in turn, maintenance of secrecy with respect to the content of the communication in the course of mail, both ways.

In order to accomplish this object, according to the invention there is provided a two-way communication medium in the form of double post card or the like comprising a two-way communication medium body 5 consisting of at least two sheet portions, said at least two sheet portions being adapted to be folded in superposed relation so that an information bearing sheet surface required to be concealed is positioned inside, and a removably adherent insertion sheet 7 for being interposed between said superposed sheet portions so that opposite surfaces of said insertion sheet 7 are releasably sticked to respective inner surfaces of said superposed sheet portions substantially all over.

As the above statement indicates, the two-way communication medium in the form of double post card or the like in accordance with the invention is of such arrangement that one sheet portion is superposed on the other sheet portion so that the surface of the one sheet portion on which the information required to be concealed is written is positioned inside. Therefore, the information requiring secrecy is prevented from exposure.

The two-way communication medium in the form of double post card or the like in accordance with the invention has a removably adherent insertion sheet 7 which is interposed between the superposed sheet portions so that at least during forward mailing the both surfaces of the insertion sheet 7 are releasably sticked to the respective inner surfaces of the superposed sheet portions substantially all over thereby to conseal the surface on which the information requiring secrecy is written. Therefore, almost no clearance is present between the insertion sheet 7 and the information bearing sheet surface, the surfaces being thus in complete adhesion contact.

Since the insertion sheet 7 is removably adherent, the information written on the one sheet surface can be read merely by releasing the insertion sheet 7.

DETAILED DESCRIPTION OF THE PREFERRED EMBODIMENTS

Figure 1A:
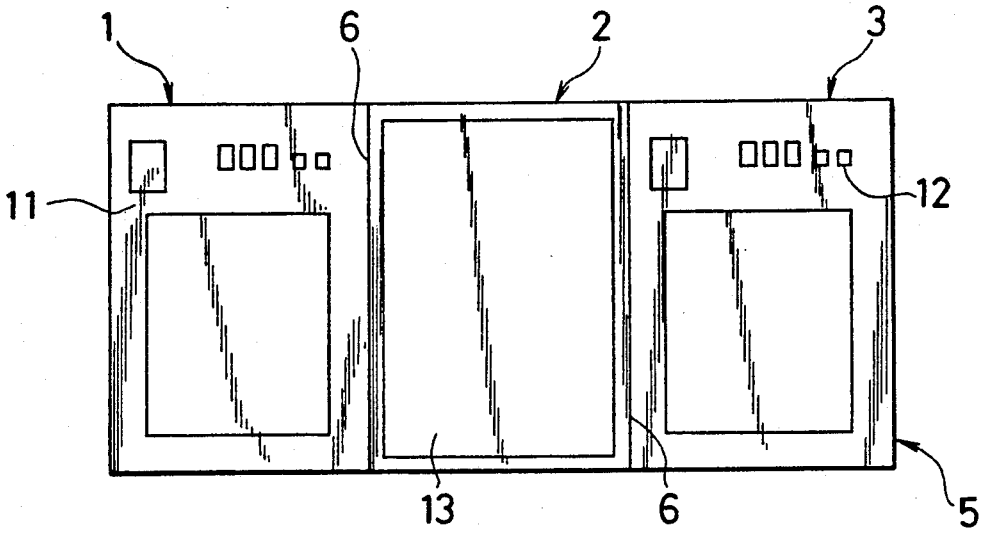
FIG. 1 illustrates a double post card representing one embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line A—A in (c); (f) is a section taken along line B—B in (d); (g) is a front view of a removably adherent insertion sheet; (h) is a section taken along line D—D in (g); and (i) is an enlarged view of portion C in (e)
Figure 1B:
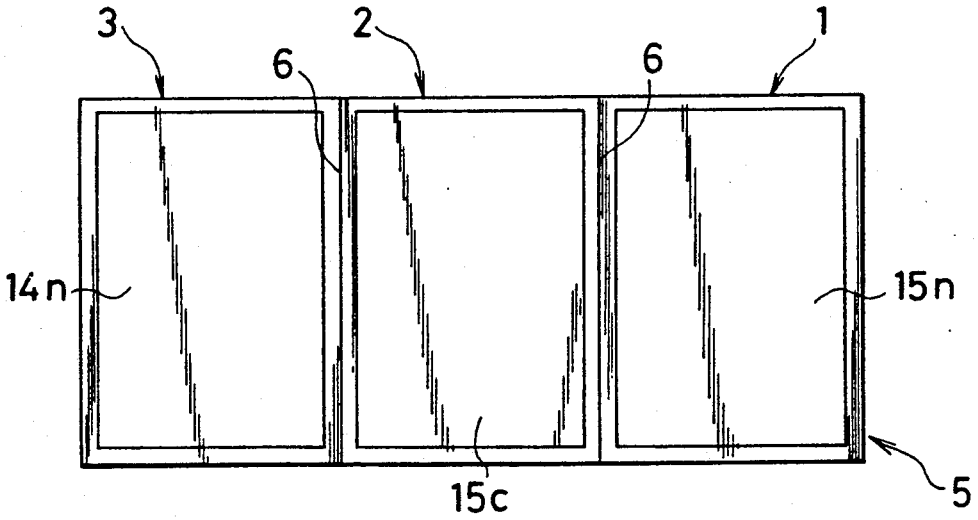
Figure 1C:
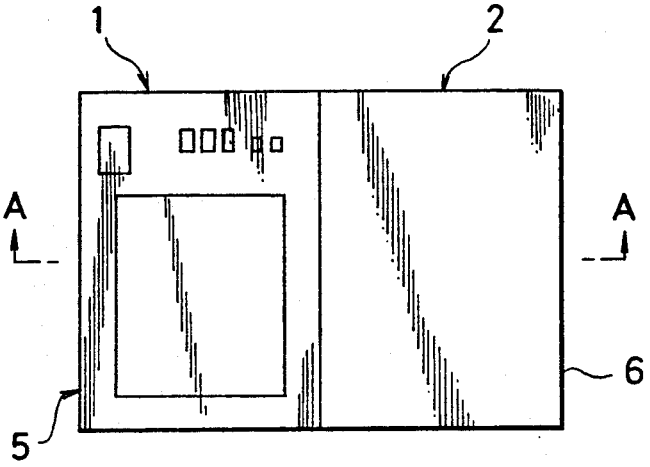
Figure 1D:
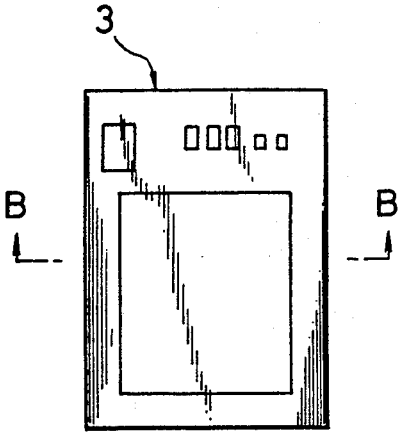
Figure 1E:
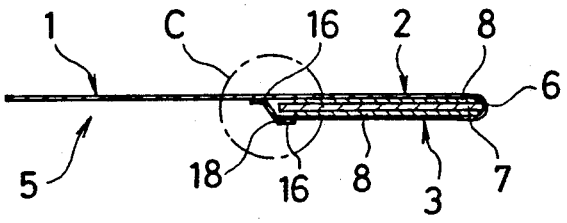
Figure 1G:
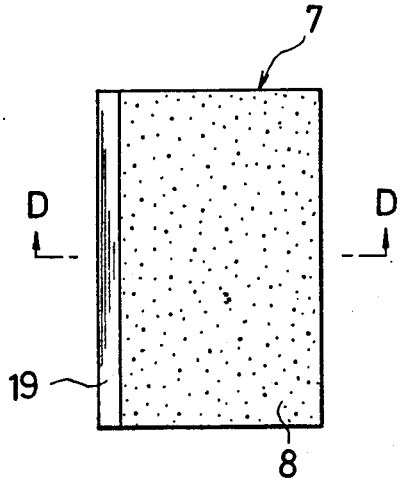
Figure 1F:
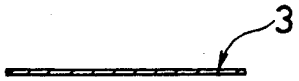
Figure 1H:
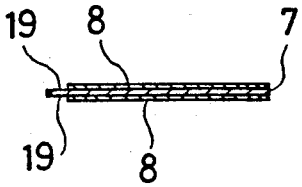
Figure 1I:
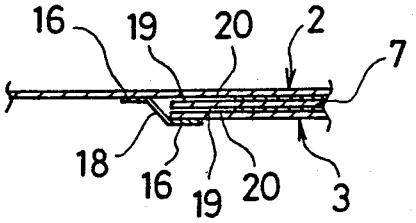
Figure 2A:
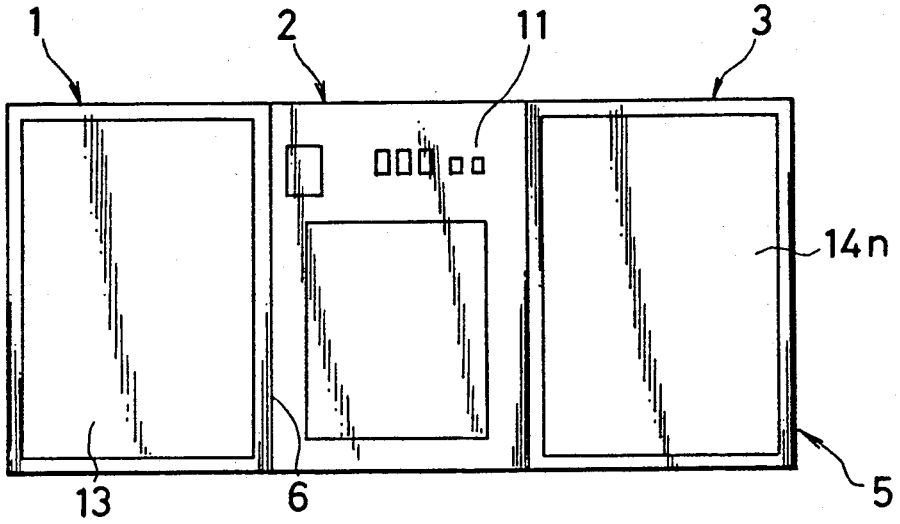
FIG. 2 illustrates a double post card representing another embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line E—E in (c); (f) is a section taken along line F—F in (d); (g) is a front view of a removably adherent insertion sheet; (h) is a section taken along line G—G in (g); and (i) is an enlarged view of portion W in (e)
Figure 2B:
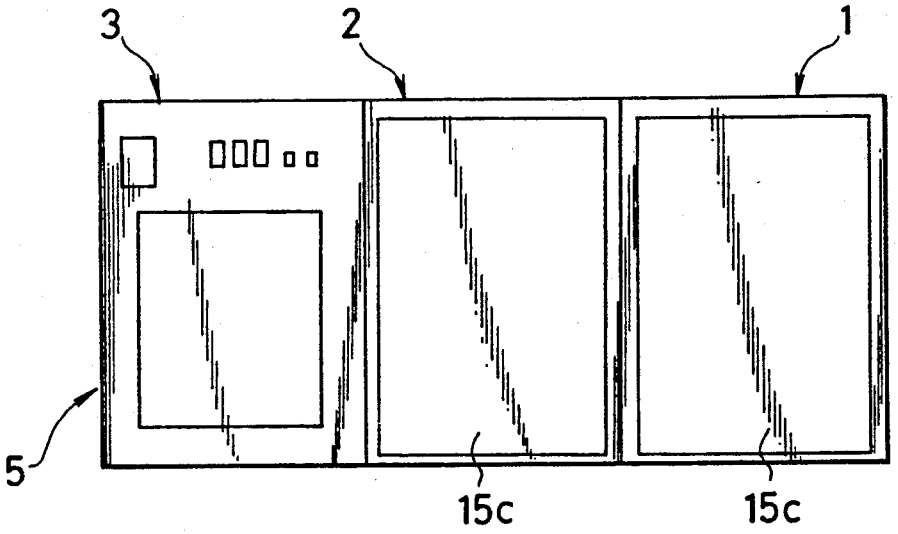
Figure 2C:
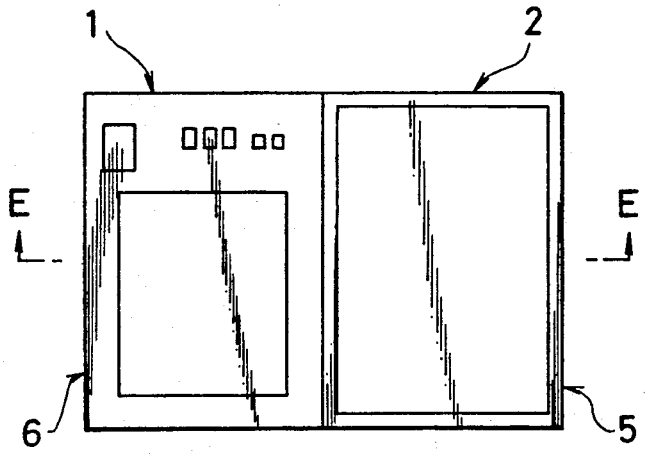
Figure 2D:
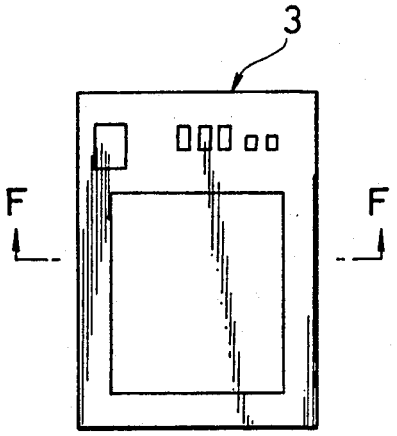
Figure 2E:
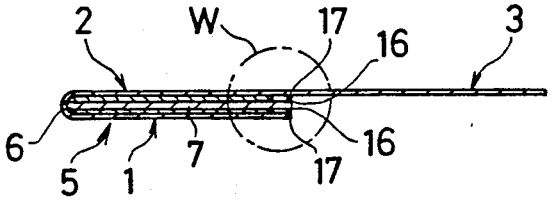
Figure 2G:
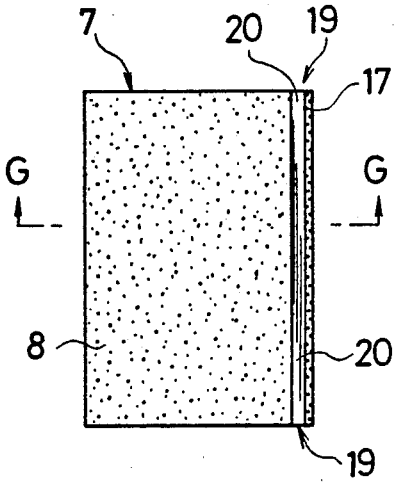
Figure 2F:
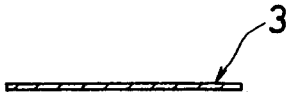
Figure 2H:
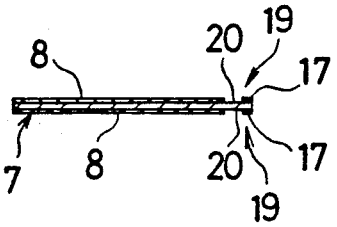
Figure 2I:
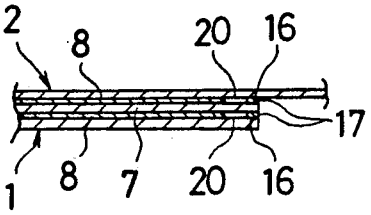
Figure 3A:
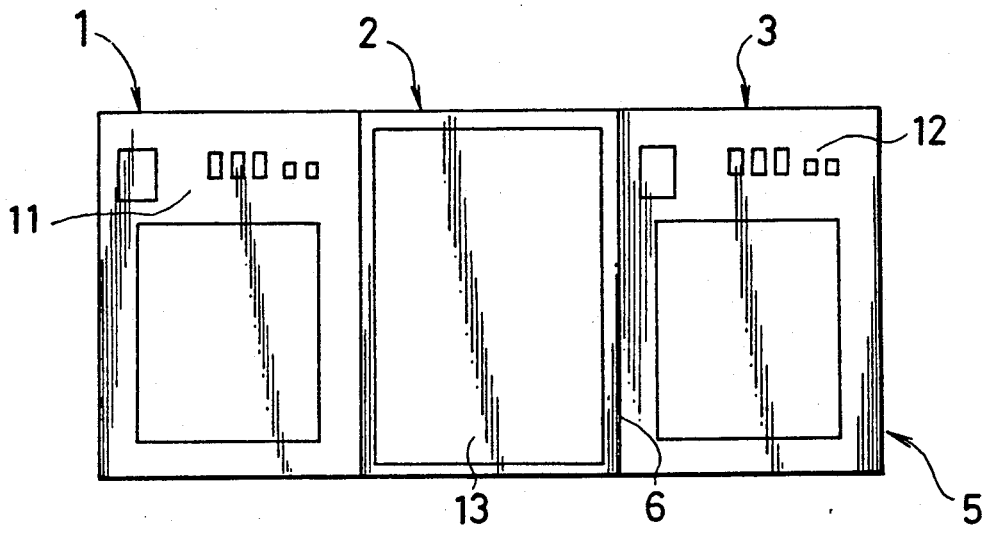
FIG. 3 illustrates a double post card representing a further embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line H—H in (c); and (f) is a section taken along line I—I in (d)
Figure 3B:
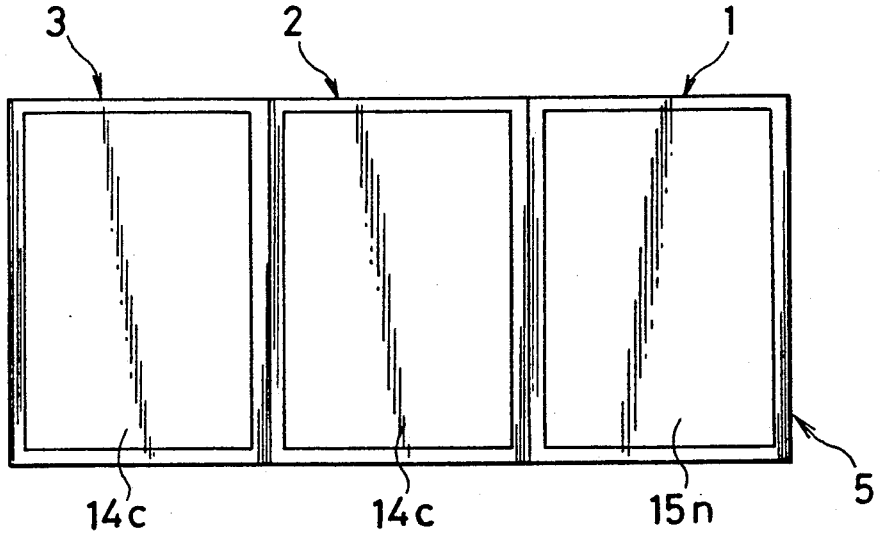
Figure 3C:
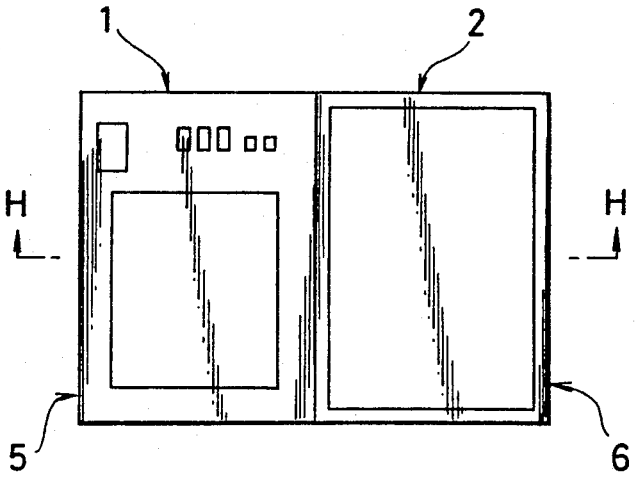
Figure 3D:
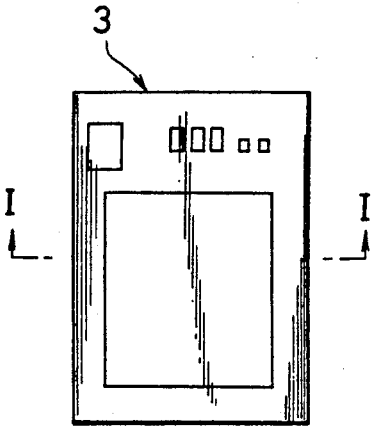
Figure 3E:
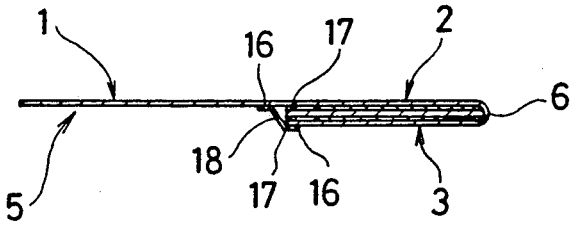
Figure 3F:
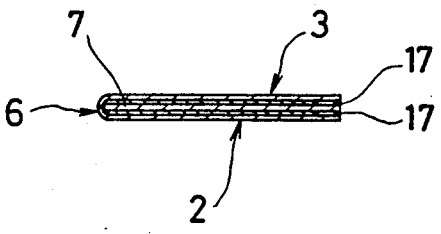
Figure 4A:
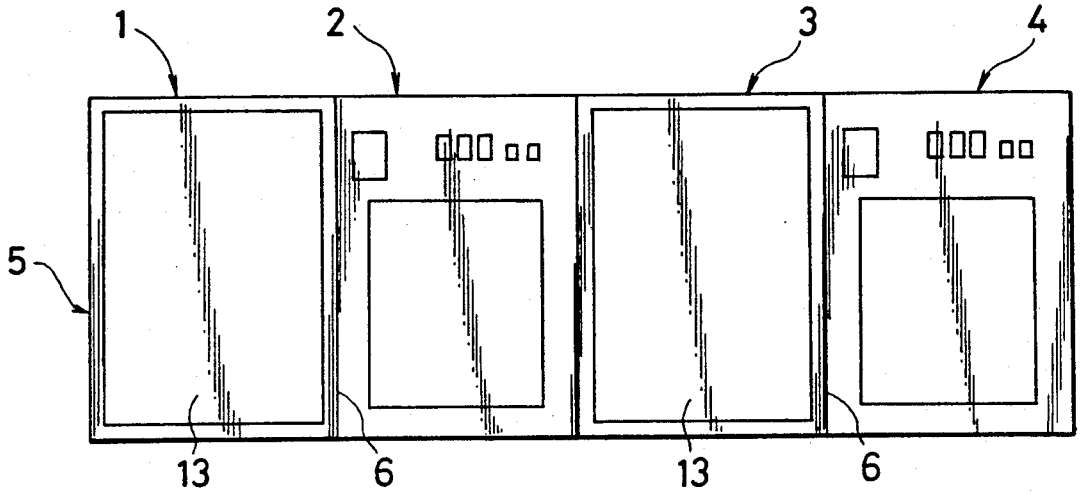
FIG. 4 illustrates a double post card representing another embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line J—J in (c); and (f) is a section taken along line K—K in (d)
Figure 4B:
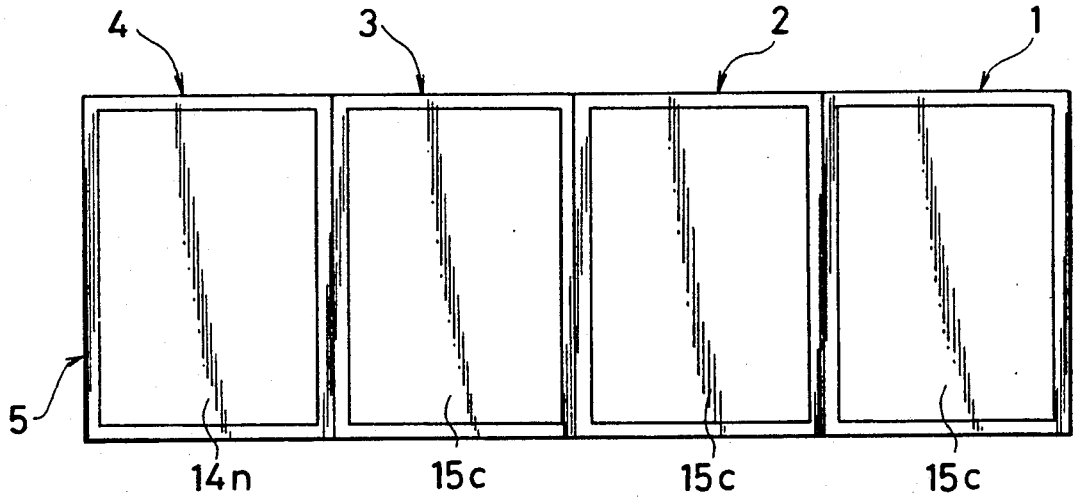
Figure 4C:
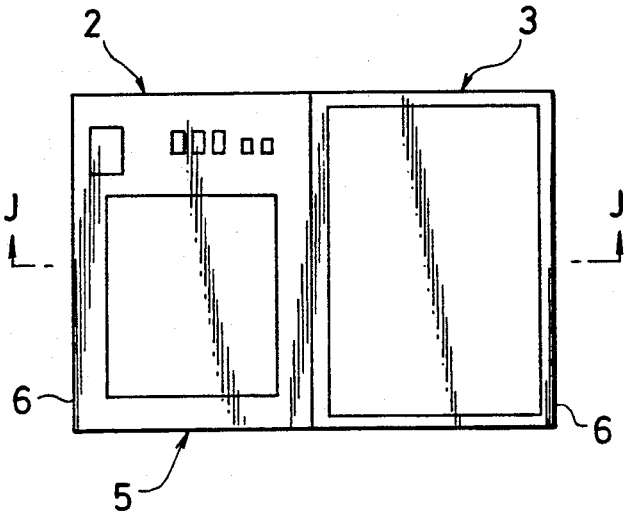
Figure 4D:
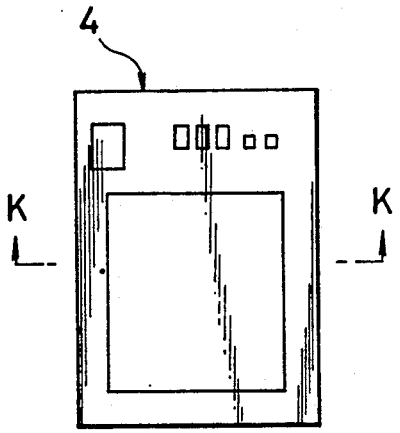
Figure 4E:
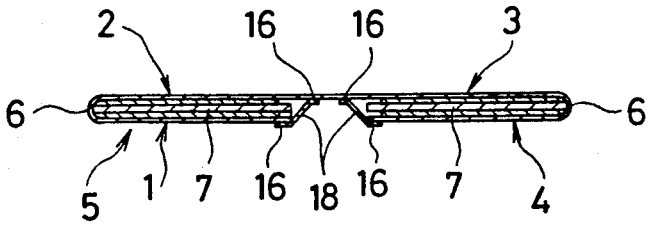
Figure 4F:
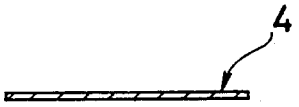
Figure 5A:
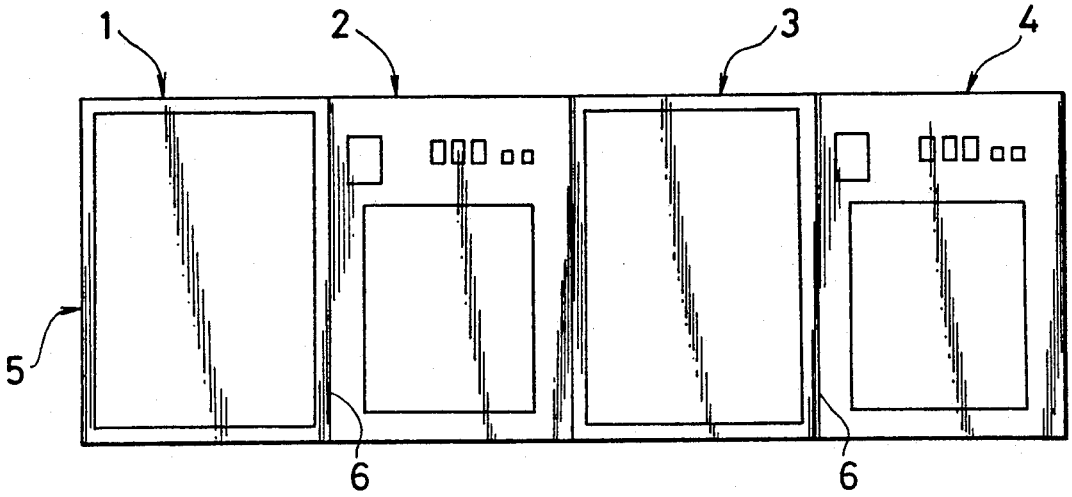
FIG. 5 illustrates a double post card representing another embodiment of the two-way communication medium in the form of double post card or the like according to the invention: (a) is a front view; (b) is a rear view; (c) is a front view of the double post card as folded for forward mailing; and (d) is a section taken on line L—L in (c)
Figure 5B:
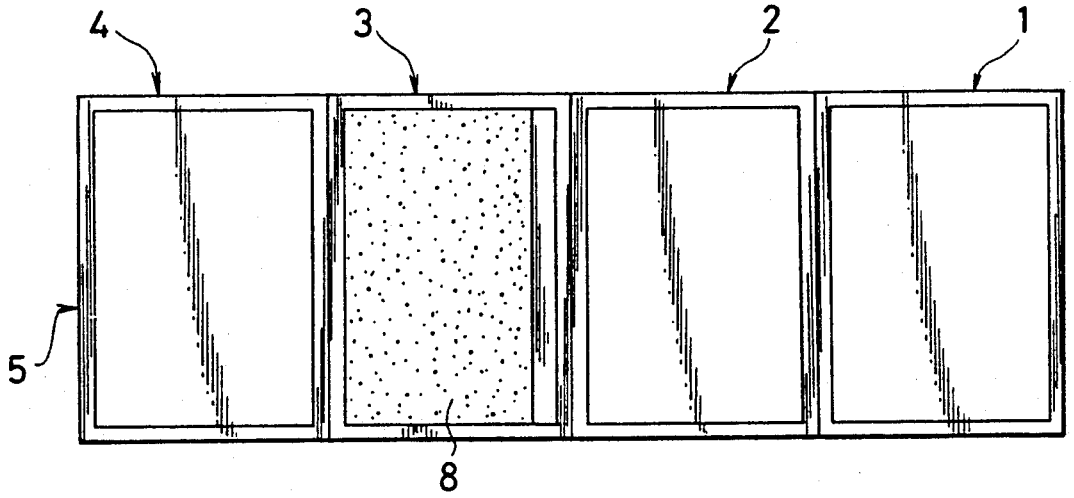
Figure 5C:
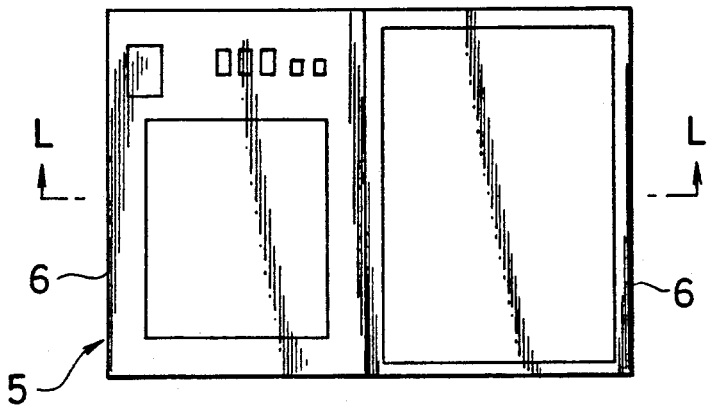
Figure 5D:
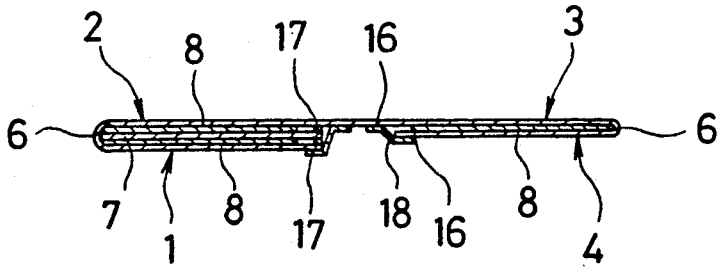

Embodiments of the invention will now be described with reference to the accompanying drawings.

EMBODIMENT NO. 1

FIG. 1 illustrates a double post card representing one embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line A—A in (c); (f) is a section taken along line B—B in (d); (g) is a front view of a removably adherent insertion sheet; (h) is a section taken along line D—D in (g); and (i) is an enlarged view of portion C in (e);

In FIG. 1, numeral 5 designates a double post card body which, as (a) and (b) of FIG. 1 show, comprises three sheet portions 1, 2, 3, each of a usual post card size, formed in continuation and defined by folding lines 6, 6.

The double post card also comprises a removably adherent insertion sheet 7 formed of an aluminum deposited film which, as (e) and (i) of FIG. 1 show, is interposed between sheet portions 2 and 3 of the three sheet portions of usual post card size when folded. The insertion sheet 7, as (e), (g), (h), (i) of FIG. 1 show, has a readily releasable adhesive 8 coated on its both surfaces except longitudinal edge portions 19, 19.

The sheet portions 2, 3 are folded in superposed relation with the insertion sheet 7 interposed therebetween and are held in adhesion contact with the readily releasable adhesive 8 coated on the insertion sheet 7.

The sheet body 5 has, on its front side, a forward addressing section 11 including a forward mail designation, a postal code frame, a postage frame, and a space for forward mailing address in the sheet portion 1, an advertisement space 13 for the initial sender in the sheet portion 2, and a reply addressing section 12 including a reply mail designation, a space for reply mailing address, etc. in the sheet portion 3, as shown in FIG. 1 (*a*), and has, on its back side, an information writing space 14*n* for supply of information from the replier to the initial sender in the sheet portion 3, and information writing spaces 15*c*, 15*c* for supply of information from the initial sender to the forward mail receiver, i. e., the replier, in the sheet portions 2, 1, as shown in FIG. 1 (*b*).

The manner of use of the double post card 5 of the above described construction will now be explained. The initial sender writes information addressed to the receiver which requires secrecy in the information writing space 15*c* of the sheet portion 2 and information requiring no secrecy in the information writing section 15*n* of the sheet portion 1. Then, as (c), (e), (i) of FIG. 1 show, the sheet portions 2, 3 are folded along the folding line 6 and the insertion sheet 7 is placed between and brought in adhesion contact with the sheet portions 2, 3; thereafter, corresponding ends 16 of the sheet portions 3 and 2 are secured together with an adhesive tape 18 so that the sheet portions 2, 3 are prevented from separating from each other.

The double post card 5 is now ready for being forwarded.

It is noted in this connection that, as (e), (g), (h), and (i) of FIG. 1 show, while the insertion sheet 7 has readily releasable adhesive coatings 8, 8 on its both surfaces substantially all over, the longitudinal edge portions 19, 19 have no adhesive coating, there being thus formed very narrow clearances 20, 20 at the longitudinal edge portions 19, 19.

Upon receipt of the double post card, the receiver removes the adhesive tape 18 and then peels the insertion sheet 7 off the sheet portions 2, 3 by utilizing the clearances 20, 20 as a handhold. After perusal of the information provided in both the information writing space 15*c* of the sheet portion 2 and the information writing space 15*n* of the sheet portion 1, the receiver writes a reply to the initial sender in the information writing space 14*n* of the sheet portion 3. Then, the sheet portion 3 is separated from the other sheet portions and, as (d) and (f) of FIG. 1 show, the sheet portion 3 only is sent to the initial sender. Needless to say, the sheet portion 3 may be separated before or after the reply is written.

In the present embodiment, as described above, the sheet portions 2, 3 are folded in superposed relation and, between them there is interposed an insertion sheet 7 coated with a readily releasable adhesive 8 substantially all over except the longitudinal edge portions 19, 19, the insertion sheet being held in adhesion contact with the sheet portions, the information writing space 15*c* being thus completely concealed. Furthermore, the insertion sheet 7 is formed of an aluminum deposited film and, therefore, the interior of the double post card cannot be seen through, the information being thus kept in complete secrecy.

In addition, the double post card body 5 is very handy because it can be prevented from opening, simply by securing respective ends 16, 16 of the sheet portions 2, 3 together by means of the adhesive tape 18.

At the receiver's end, the adhesive tape 18 is removed and the insertion sheet 7 which is in adhesion contact with the sheet portions can be readily released from the sheet portions by bare hand using the clearances 20, 20 at the longitudinal edge portions 19, 19 as a handhold. Therefore, little or no trouble is involved before the information written is ready for perusal.

In this way, the embodiment provides a double post card as a two-way communication medium which enables easy and complete concealment of information requiring secrecy and two-way communication through a single medium and in a very handy way of such information together with information requiring no secrecy.

EMBODIMENT NO. 2

FIG. 2 illustrates another form of double post card embodying the two-way communication medium of the present invention.

This embodiment is similar to the above described embodiment No. 1 in that the double post card body 5 comprises three sheet portions and in that, as (a) and (b) of FIG. 2 show, an advertisment space 13, a forward mail addressing section 11, an information writing space 15 for supply of information from the initial sender to the replier, and an information writing space for supply of information from the replier to the initial sender are provided on predetermined sheet surfaces.

In this embodiment, as (e), (g), (h), and (i) of FIG. 2 show, unreleasable adhesive coatings 17, 17 are provided at respective ends 16, 16 of longitudinal edge portions 19, 19 of an insertion sheet 7 on both surface sides thereof, and clearances 20, 20 are provided adjacent the adhesive coatings 17, 17. Further, the remaining portions of both surfaces of the insertion sheet 7 are provided with releasably adherent adhesive coatings 8, 8.

In use of the double post card of the above described arrangement, as (b), (c), (e), and (i) of FIG. 2 show, the initial sender writes information addressed to the receiver which requires secrecy in information writing spaces 15*c*, 15*c* on the respective back surface sides of sheet portions 1, then folds the sheet portions 1, 2 along a folding line 6, and insert the insertion sheet 7 between the sheet portions and hold it in adhesion contact with them. Thereafter, the unreleasable adhesive coatings 17, 17 provided at the ends 16, 16 of the insertion sheet 7 are moistened into activated condition thereby to bring the sheet portion 2 and the sheet portion 1 into unreleasable adhesion bond. Thus, the sheet portions are prevented from separation from each other, the double post card 5 being now ready for being forwarded.

Upon receipt of the double post card 5, the receiver cuts off portions corresponding to the clearances 20, 20 in the double post card 5 to open the double post card body. After perusal of the information given in the information writing spaces 15*c*, 15*c*, the receiver separates the sheet portion 3 only, as (d) and (f) of FIG. 2 show, and returns same to the initial sender.

This embodiment is similar to Embodiment No. 1 in that it enables easy and complete concealment of information requiring secrecy, but is different from the latter in that protection of the sheet portions against separation during forward mailing is provided by means of unreleasable adhesive coatings 17, 17 in particular, and in that the double post card is sent in such condition that the information writing spaces 15*c*, 15*c* are concealed, it being thus possible to communicate more information requiring secrecy.

EMBODIMENT NO. 3

FIG. 3 illustrates another form of double post card embodying the two-way communication medium of the invention. This embodiment is similar to Embodiment Nos. 1 and 2 in that the double communication sheet body 5 comprises three sheet portions and in that, as (a) and (b) of FIG. 3 show, there are provided a forward mail addressing section 11, a reply mail addressing section 12, and an advertisement space 13, and also information writing spaces 14, 15, but is different from the latter mentioned embodiments in that two surfaces including information writing spaces 14*c*, 14*c* are applied for reply writing by the replier to the initial sender and those surfaces are concealed during return mail, while only one surface with an information writing space 15*n* is applied for information supply from the initial sender to the replier, which one surface is exposed.

In the two-way communication medium of the above described arrangement, as (c) and (e) of FIG. 3 show, during forward mailing the sheet portions 2, 3 are folded along a folding line 6, with the information writing spaces 14*c*, 14*c* placed inside, and an insertion sheet 7 is interposed between and held in adhesion contact with the sheet portions; and respective ends 16, 16 of the sheet portions 2, 3 are fastened together by means of an adhesive tape 18. In this case, unreleasable adhesive coatings 17, 17 provided at ends of the insertion sheet 7 are not moistened into activated condition, the adhesive 17 being simply in touch with the sheet portions 2 and 1 and not in adhesion contact with them.

After perusal of the information given in the information writing space 15*n*, the adhesive tape 18 is removed and the sheet portion 1 is separated from the other sheet portions. Then, as (d) and (f) of FIG. 3 show, a reply to the initial sender is written in the information writing spaces 14*c*, 14*c* of the sheet portions 2, 3. The sheet portions 2, 3 are folded together, with the information writing spaces 14*c*, 14*c* placed inside, and the unreleasable adhesives 17, 17 provided on the insertion sheet 7 placed between the sheet portions 2, 3 for adhesion bond therewith are moistened into activated condition, whereby the sheet portions can be held in adhesion bond with the insertion sheet and thus prevented from separation. The sheet portions are now ready for being sent to the initial sender.

As stated above, in this embodiment the information from the initial sender to the replier as given in the information writing space 15*n* is exposed, but during both forward mailing and reply mailing the insertion sheet 7 is interposed between and held in adhesion bond with the sheet portions 2 and 3 and, further, the sheet portions 2, 3 are fastened together by means of the adhesive tape 18 during forward mailing and and held in adhesion bond by means of unreleasable adhesive coatings 17, 17 during reply mailing, so that surfaces including the information writing spaces 14*c*, 14*c* for information supply from the replier to the initial sender are completely concealed.

Therefore, in cases where detailed information requiring secrecy is to be sent in reply to comparatively simple information requiring no secrecy, the two-way communication medium of the present embodiment is particularly useful. In addition, the communication sheet is very handy because the sheet portions can be prevented from separation during reply mailing simply by means of unreleasable adhesive coatings 17.

EMBODIMENT NO. 4

FIG. 4 is another form of double post card as a two-way communication medium embodying the invention. In this embodiment, as (a) and (b) of FIG. 4 show, the two-way communication body 5 comprises four sheet portions 1, 2, 3, 4 and two surfaces are applied for use as advertisement spaces, three surfaces being applied for use as information writing spaces 15 for supply of information from the initial sender to the replier, one surface being applied for use as information writing space 14 for supply of information from the replier to the initial sender.

In the double post card of the above described construction, as (c) and (e) of FIG. 4 show, for forward mailing purposes, two sheet portions 1, 2 and another two sheet portions 3, 4 are respectively folded along corresponding folding lines 6, with three information writing spaces 15*c*, 15*c*, 15*c* placed inside for being concealed, and insertion sheets 7, 7 are respectively interposed between and held in adhesion contact with corresponding ones of those sheet portions. Further, respective ends 16, 16 of the sheet portions 1, 2 and respective ends 16, 16 of the sheet portions 3, 4 are individually fastened together by means of corresponding adhesive tapes 18, 18.

After perusal of the information given in the information writing spaces 15*c*, 15*c*, 15*c*, the receiver of the forward mail separates the sheet portion 4 from the other sheet portions, as (d) and (f) of FIG. 4 show, and writes a reply in the information writing space therein. Only the sheet portion 4 is returned to the initial sender.

In this embodiment, as stated above, three surfaces are applied for use as information writing spaces for information supply from the initial sender to the replier; therefore, information can be supplied in greater detail and in a larger amount from the initial sender to the receiver. Further, insertion sheet 7 is interposed between and held in adhesion contact with each corresponding pair of sheet portions, and two sheet portions 1, 2 and another two sheet portions 3, 4 are respectively fastened together by adhesive tapes 18, 18. Therefore, the sheet portions can be prevented from separation, it being thus possible to ensure positive maintenance of secrecy.

Only one surface is applied for use as information writing space for information supply from the replier to the initial sender. Therefore, the two-way communication medium of this embodiment is suitable for use in the case where brief information requiring no secrecy is supplied from the replier to the initial sender.

EMBODIMENT NO. 5

FIG. 5 illustrates another form of double post card as a two-way communication medium embodying the invention. This embodiment is similar to Embodiment No. 4 except the number of insertion sheets and means for prevention of sheet portions from separation as used for forward mailing purposes.

In this embodiment, as (c) and (d) of FIG. 5 show, an insertion sheet 7 is interposed between and held in adhesion contact with sheet portions 1, 2, and the sheet portions 1, 2 are prevented from separation by means of unreleasable adhesive coatings 17, 17 provided at end portions of the insertion sheet whereby the information contained is concealed. However, the present embodiment is different from Embodiment No. 4 in that, as (b) and (d) of FIG. 5 show, no insertion sheet 7 is used for adhesion contact between sheet portions 3, 4, such adhesion contact being effected by a releasably adherent adhesive 8, and in that, as (d) of FIG. 5 shows, the sheet portions 3, 4 are prevented from separation, by holding respective ends 16, 16 of the sheet portions 3, 4 in adhesion contact with an adhesive tape 18.

EMBODIMENT NO. 6

Figure 6:
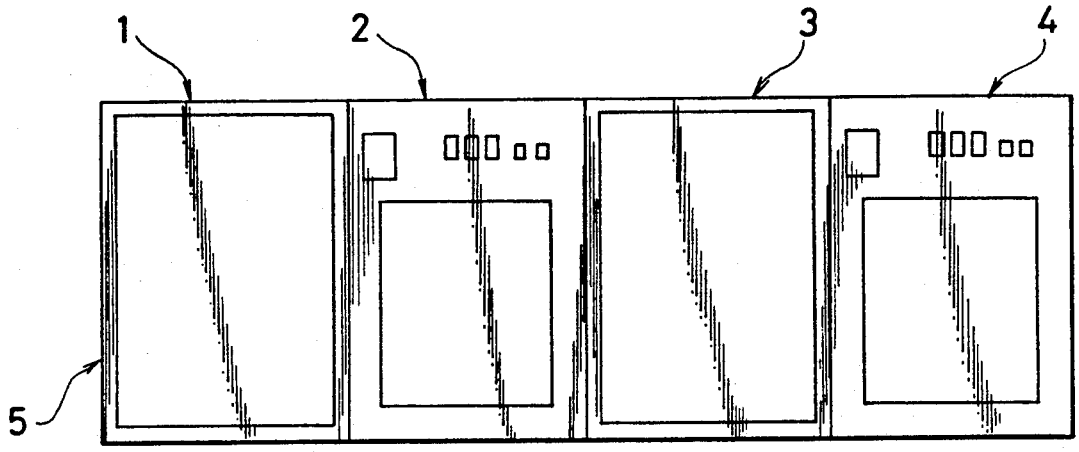
FIG. 6 illustrates a double post card representing another embodiment of the two-way communication medium in the form of double post card or the like according to the invention: (a) is a front view; (b) is a rear view; (c) is a front view of the double post card as folded for forward mailing; and (d) is a section taken on line M—M in (c)
Figure 6:
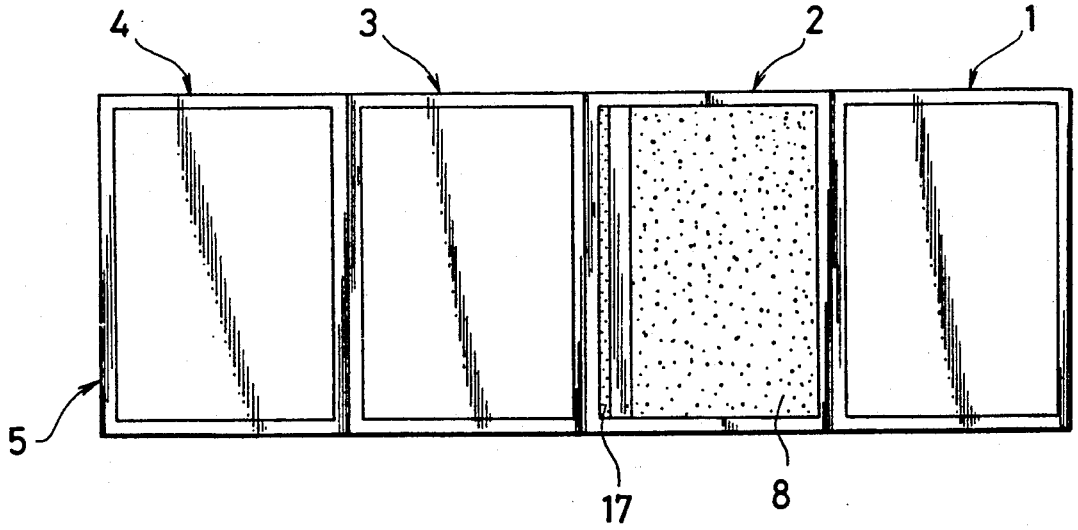
Figure 6:
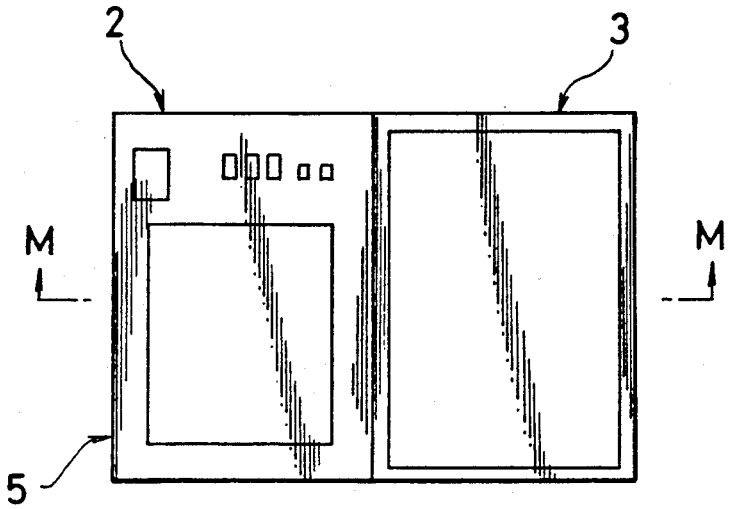
Figure 6:
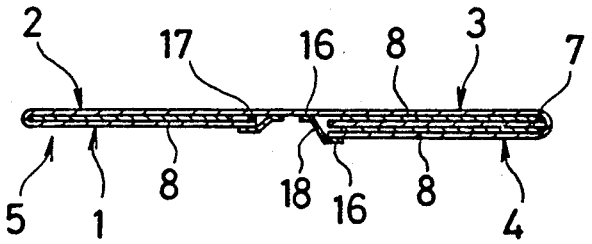
Figure 7A:
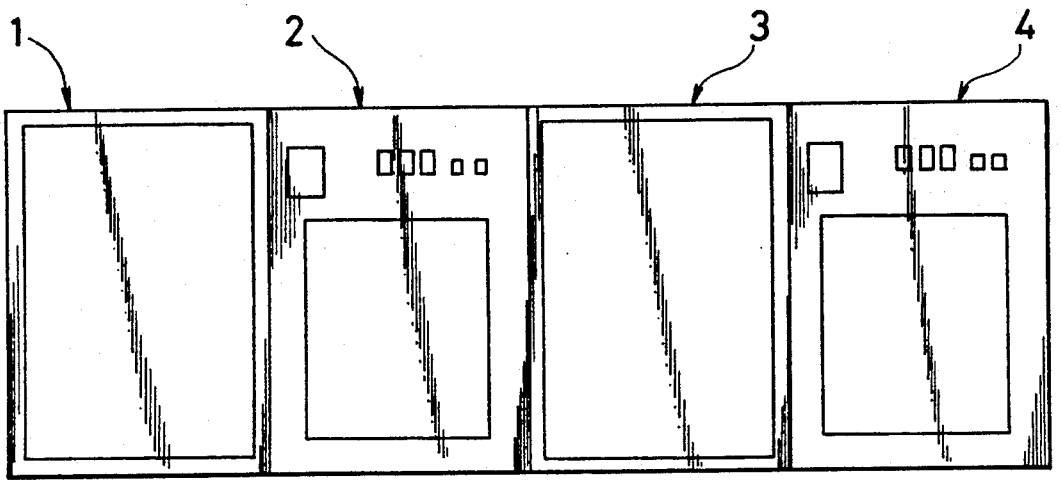
FIG. 7 illustrates a double post card representing a further embodiment of the two-way communication medium in the form of double post card or the like according to the invention: (a) is a front view; (b) is a rear view; (c) is a front view of the double post card as folded for forward mailing; (d) is a front view of the double post card as folded for reply mailing; (e) is a section taken along line P—P in (c); and (f) is a section taken along line Q—Q in (d)
Figure 7B:
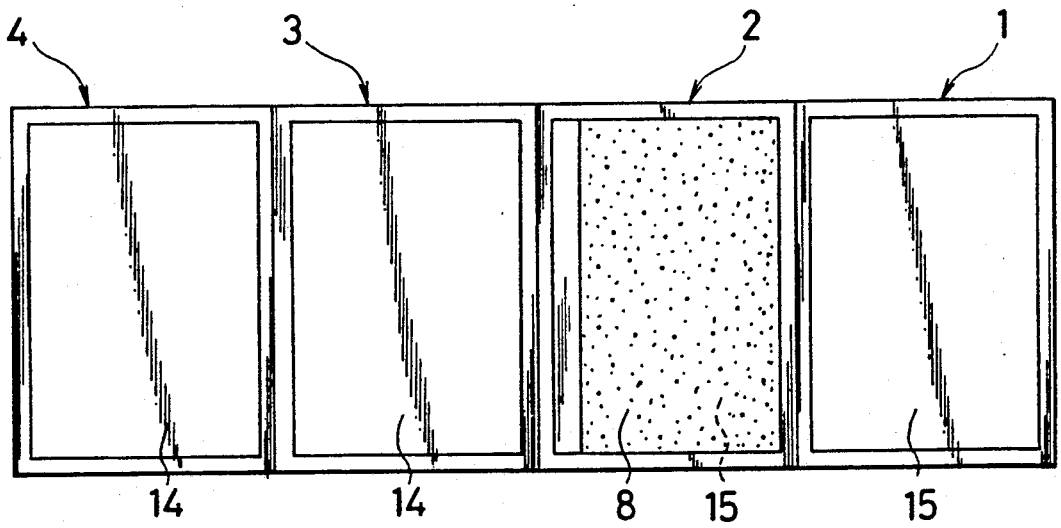
Figure 7C:
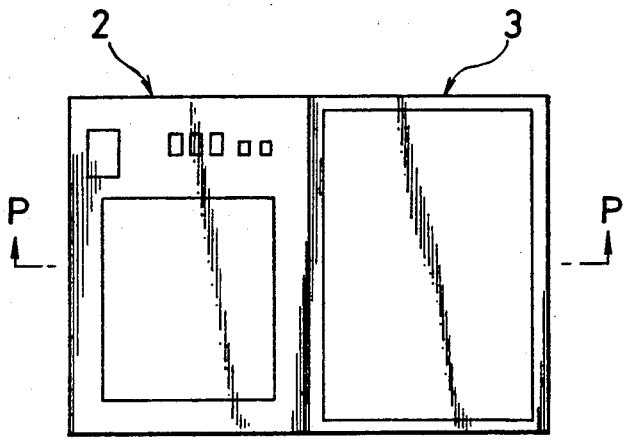
Figure 7D:
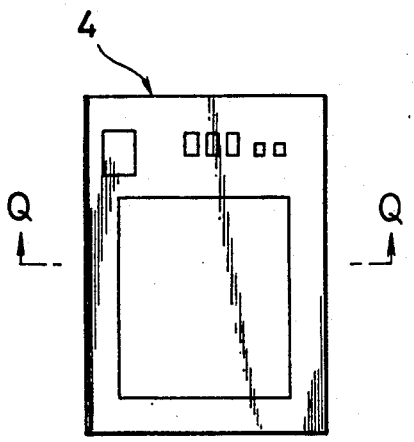
Figure 7E:
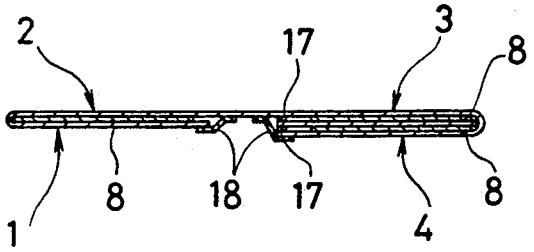
Figure 7F:
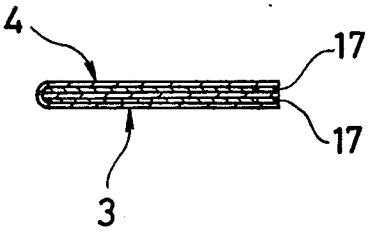

FIG. 6 illustrates another form of double post card as a two-way communication medium embodying the invention. In this embodiment, as (d) of FIG. 6 shows, an insertion sheet 7 is interposed between sheet portions 3, 4 for adhesion contact therewith and not between sheet portions 1, 2, and as (b), (c), and (d) of FIG. 6 show, the sheet portions 1, 2 are held in adhesion contact with each other by means of a releasably adherent adhesive 8 provided directly on the back side of the sheet portion 2. Further, as (d) of FIG. 6 shows, the sheet portions 1, 2 are prevented from separation, by means of an unreleasable adhesive 17 provided at an end of the sheet portion 2, while sheet portions 3, 4 are prevented from separation, by holding respective ends 16 of sheet portions 3, 4 in adhesion contact with each other by means of an adhesive tape 18.

EMBODIMENT NO. 7

FIG. 7 illustrates another form of double post card as a two-way communication medium embodying the invention. This embodiment is similar to Embodiment Nos. 4 through 6 in that the two-way communication body 5 comprises four sheet portions, but in this embodiment, as (a) and (b) of FIG. 7 show, two surfaces are applied for use as information writing spaces 15 for supply of information from the initial sender to the replier, and two surfaces are applied for use as information writing spaces 14 for information supply from the replier to the initial sender. That is, as compared with Embodiment Nos. 4 to 6, the present embodiment has information writing spaces 15 smaller in number by one and information writing spaces 14 larger in number by one.

As (b) and (e) of FIG. 7 show, during forward mailing, sheet portions 1, 2 are held in adhesion contact with each other by means of an adhesive 8 provided on the back of the sheet portion 2, while as (e) of FIG. 7 shows, both sheet portions 1, 2 and sheet portions 3, 4 are prevented from separation, by means of corresponding adhesive tapes 3 and 5.

For the purpose of preventing separation of sheet portions during reply mailing, sheet portions 3, 4 are folded toward each other and held in adhesion bond with unreleasable adhesive coatings 17, 17, as shown in (d) and (f) of FIG. 7.

In this embodiment, as above described, for purposes of both forward communication and reply communication, two surfaces each are applied for use as information writing spaces and they are kept in concealed condition. Therefore, the embodiment enables both the initial sender and the replier to send a comparatively large amount of information in secret.

EMBODIMENT NO. 8

Figure 8A:
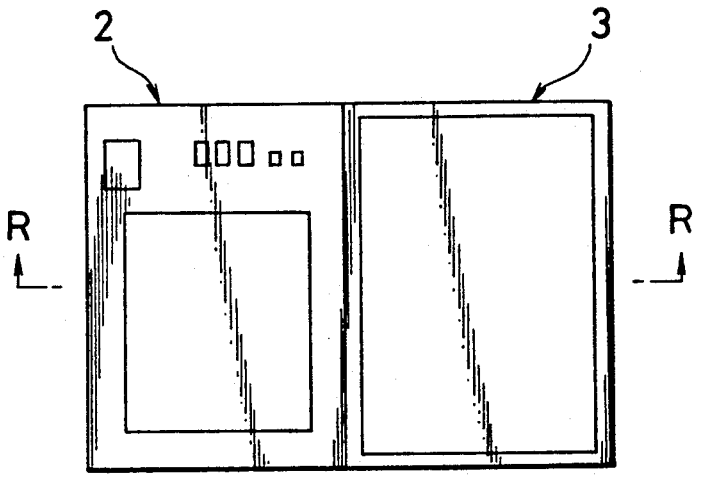
FIG. 8 illustrates a double post card representing a still further embodiment of the two-way communication medium in the form of double post card or the like according to the invention: (a) is a front view of the double post card as folded for forward mailing; and (b) is a section taken along line R—R in (a)
Figure 8B:
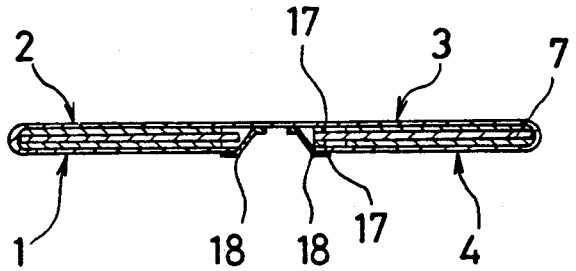
Figure 9A:
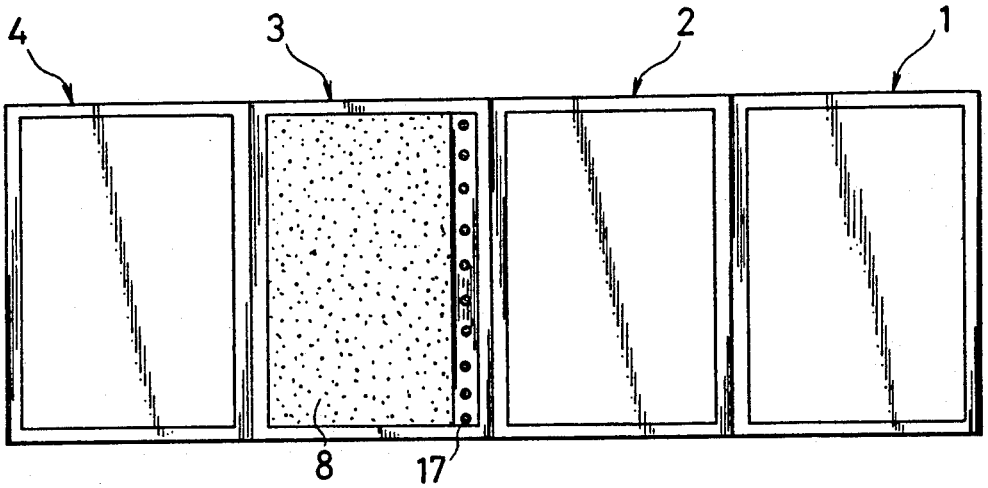
FIG. 9 illustrates a double post card representing another embodiment of the two-way communication medium in the form of double post card or the like according to the invention: (a) is a rear view; (b) is a front view of the double post card as folded for forward mailing; (c) is a front view of the double post card as folded for reply mailing; (d) is a section taken along line T—T in (b); and (e) is a section taken along line U—U in (c)
Figure 9B:
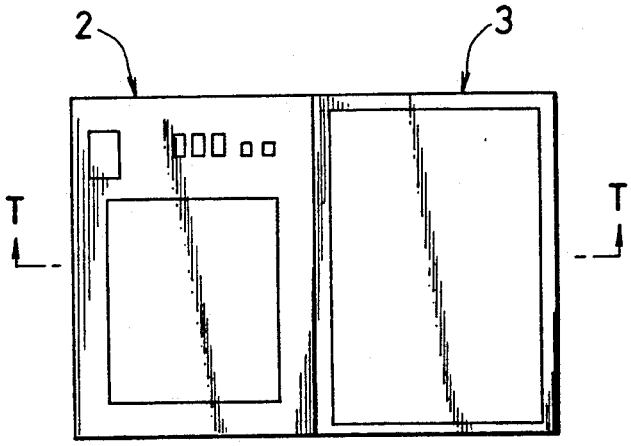
Figure 9C:
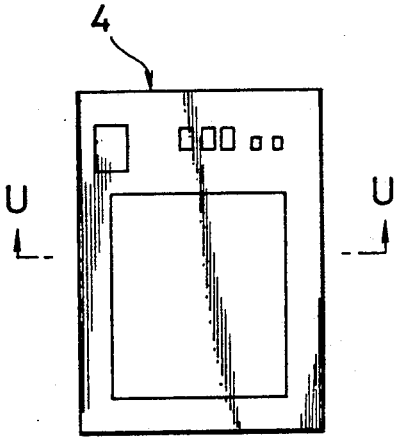
Figure 9D:
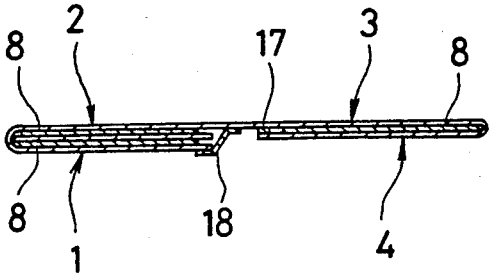
Figure 9E:
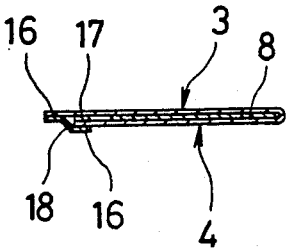
Figure 10:
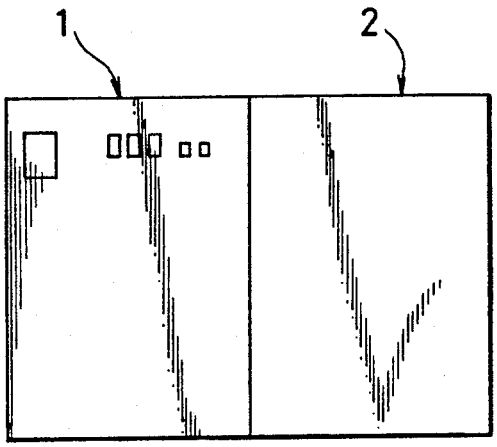
FIG. 10 (a) Prior Art
FIG. 10 illustrates a conventional double post card: (a) is a front view; (b) is a rear view; (c) is a perspective view of the double post card as folded for forward mailing; and (d) is a perspective view of the card folded for reply mailing.
Figure 10:
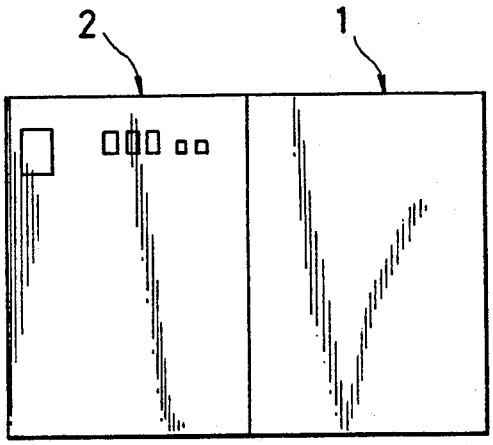
FIG. 10 (b) Prior Art
Figure 10:
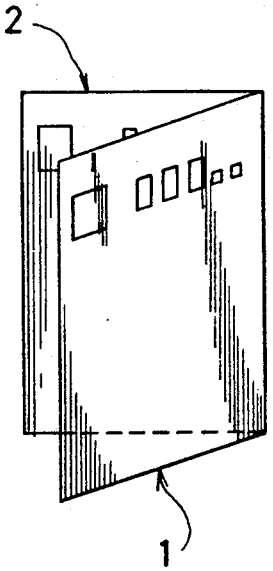
FIG. 10 (c) Prior Art
Figure 10:
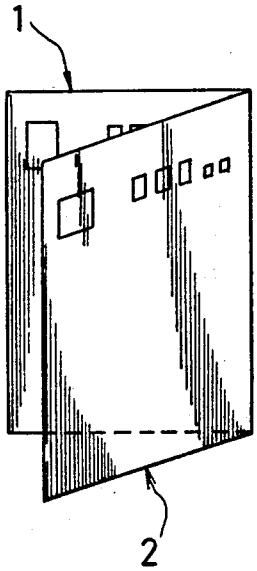
FIG. 10 (d) Prior Art

FIG. 8 illustrates another form of double post card as a two-way communication medium embodying the invention. The embodiment is similar to Embodiment No. 7 with the exception of adhesion means for sheet portions for use in forward mailing.

For the purpose of forward mailing, as (a) and (b) of FIG. 8 show, adhesive tapes 18, 18 are used for preventing separation of sheet portions 1, 2 and of sheet portions 3, 4, and adhesive coatings 8 provided on both sides of insertion sheet 7 are used for keeping the sheet portions 1 and 2 in adhesion contact. In same way as in Embodiment Nos. 3 and 7, unreleasable adhesive coatings 17, 17 provided at ends 16, 16 of the insertion sheet 7 interposed between the sheet portions 3 and 4 are utilized for preventing the sheet portions 3, 4 from separation for the purpose of reply communication.

EMBODIMENT NO. 9

FIG. 9 illustrates another form of double post card as a two-way communication medium embodying the invention. This embodiment is similar to Embodiment No. 5 with the exception of preventive means against separation of sheet portions used for both forward and reply communication purposes.

In this embodiment, as (a), (b), and (d) of FIG. 9 show, during forward mailing, sheet portions 1, 2 are prevented from separation, by means of an adhesive tape 18, and sheet portions 3, 4 are prevented from separation, by means of unreleasable adhesive coatings 17, 17 . . . provided in dot fashion at back side end of the sheet portion 3. In this case, the adhesive coatings 17, 17 . . . are unreleasable but they are provided in dot fashion; therefore, the post card can be forcibly opened without any particular difficulty. For the purpose of reply communication, as (c) and (e) of FIG. 9 show, it is possible to prevent sheet portions from separation by fastening respective ends 16, 16 of the sheet portions 3, 4 together by means of an adhesive tape 18. The dotted adhesive coatings 17 . . . used during forward mailing are not used in this case.

OTHER EMBODIMENTS

In the foregoing embodiments, at the time of forward mailing, a two-way communication body 5 consisting of at least two sheet portions formed in continuation is folded along a folding line in superposed relation, and a releasably adherent insertion sheet 7 is interposed between and held in adhesion contact with the sheet portions. However, the sheet portions may be in separated condition insofar as the sheet portions can be placed one over another without the information requiring secrecy as written on the specified sheet surface or surfaces being exposed. Whether or not the sheet body 5 is in continuous form is not important.

In the above described embodiments, the individual sheet portions are of same size, but they may not necessarily be of same size insofar as the individual sheet portions can be effectively used as such without the information requiring secrecy as written on the specified sheet surface or surfaces being exposed.

The number of sheet portions, the number of information writing spaces, the number of advertisement spaces, and arrangement thereof are not limited to those shown in the foregoing embodiments, and may be varied or altered as required.

In the foregoing embodiments, an adhesive tape 18 or unreleasable adhesive 17 is used in order to prevent the sheet portions from separation, but use of such means is not limited to that illustrated in the embodiments. Needless to say, such means may be changed in design in consideration of the convenience of the initial sender or the receiver.

In the foregoing embodiments, the releasably adherent insertion sheet 7 is formed of an aluminum deposited film which provides a desirable effect such that the information given in the interior of the sheet portions is prevented from being seen through. However, the material of the insertion sheet 7 is not limited to such film. The material may be any other film or paper, for example.

In the foregoing embodiments, no mention is made of the manner of cutting one to three sheet portions for the purpose of reply mailing. To facilitate such cutting, it is of course possible to provide perforations at a specified site of the two-way communication medium body 5.

The foregoing embodiments relate to a two-way communication medium for advertisement, information supply, etc, from the initial sender to the replier, and communication from the replier in answer thereto. However, the scope of application of the two-way communication medium according to the invention is not limited to that referred to in the embodiments; not only is the invention applicable for business purposes, but also it is applicable for use in other areas, such as greetings and answers thereto, supply of problems for exercise in a correspondence course of education and response thereto, and so on. The information writing spaces 14, 15 in particular are used for writing questionnaire and answer thereto, an invitation for purchase and details of a purchase order, and pieces of information exchanged between the sender and the receiver. Needless to say, however, such information writing section may be used in various different ways as required according to the purposes for which the communication medium is used. The advertisement space 13 for writing the initial sender's advertisement can of course be used for writing information therein.

This invention is mainly intended to provide such two-way communication medium as above described, but it is needless to say that the invention is applicable to other areas of communication media.

What is claimed is:

1. A two-way communication medium in the form of a double post card comprising a two-way communication medium body consisting of at least two sheet portions, said at least two sheet portions being adapted to be folded in superposed relation so that an information bearing sheet surface required to be concealed is positioned inside, and a removably adherent insertion sheet for being interposed between said superposed sheet portions so that opposite surfaces of said insertion sheet are releasably bonded to respective inner surfaces of said superposed sheet portions substantially all over, and wherein said insertion sheet or said sheet portions are coated with a releasably adherent adhesive over the surface thereof except longitudinal edge portions and said longitudinal edge portions are provided with an unreleasable adhesive coating spaced from said releasably adherent adhesive with a clearance defined therebetween.

2. A two-way communication medium in the form of double post card or the like as set forth in claim 1, wherein said insertion sheet is an aluminum deposited film.

3. A two-way communication medium in the form of double post card or the like as set forth in claim 1, wherein the sheet portions of said two-way communication medium body are provided on either the front surface or back surface thereof with a forward mail addressing section and a reply addressing section respectively, and are also provided with information writing spaces on the other surface than the surface on which said forward addressing and reply addressing sections are provided.

4. A two-way communication medium in the form of double post card or the like as set forth in claim 1, wherein said two-way communication medium body consists of three sheet portions.

5. A two-way communication medium in the form of double post card or the like as set forth in claim 1, wherein said two-way communication medium body consists of four sheet portions.

* * * * *